US007642462B2

(12) United States Patent
Veggetti et al.

(10) Patent No.: US 7,642,462 B2
(45) Date of Patent: Jan. 5, 2010

(54) MULTIPOLAR CABLE FOR TRANSMITTING ENERGY AND/OR SIGNALS, METHOD AND APPARATUS FOR THE PRODUCTION THEREOF

(75) Inventors: Paolo Veggetti, Milan (IT); Sergio Belli, Milan (IT); Luca Balconi, Milan (IT); Luca De Rai, Milan (IT); Angelo Riella, Milan (IT); Vincenzo Crisci, Milan (IT)

(73) Assignee: Prysmian Cavi e Sistemi Energia, Milan (IT)

( * ) Notice: Subject to any disclaimer, the term of this patent is extended or adjusted under 35 U.S.C. 154(b) by 0 days.

(21) Appl. No.: 10/584,989

(22) PCT Filed: Dec. 30, 2003

(86) PCT No.: PCT/IB03/06407

§ 371 (c)(1),
(2), (4) Date: May 24, 2007

(87) PCT Pub. No.: WO2005/066978

PCT Pub. Date: Jul. 21, 2005

(65) Prior Publication Data

US 2007/0251716 A1 Nov. 1, 2007

(51) Int. Cl.
*H01B 7/00* (2006.01)

(52) U.S. Cl. ..... 174/113 R; 174/115

(58) Field of Classification Search ..... 174/113 R, 174/115

See application file for complete search history.

(56) References Cited

U.S. PATENT DOCUMENTS

| | | | | |
|---|---|---|---|---|
| 2,218,830 | A | 10/1940 | Rose et al. | |
| 2,950,338 | A * | 8/1960 | Taylor | 174/40 R |
| 6,881,903 | B2 * | 4/2005 | Greiner et al. | 174/113 R |

FOREIGN PATENT DOCUMENTS

| | | |
|---|---|---|
| DE | 2 200 105 | 12/1972 |
| DE | 40 04 229 | 2/1990 |
| DE | 101 19 653 | 4/2001 |
| JP | 2002-216545 | 8/2002 |
| WO | WO 02/059912 | 8/2002 |
| WO | WO 02/086914 | * 10/2002 |

* cited by examiner

*Primary Examiner*—Chau N Nguyen
(74) *Attorney, Agent, or Firm*—Finnegan, Henderson, Farabow, Garrett & Dunner, LLP

(57) ABSTRACT

A multipolar cable for transmitting energy and/or signals, as well as an extrusion method and apparatus for the production thereof, is described. The multipolar cable has at least three transmissive elements and a sheath in which at least three longitudinal housings being intended to house respectively the at least three transmissive elements according to a predetermined configuration and being formed within respective substantially lobe-shaped longitudinal portions of the sheath. The multipolar cable allows the connection of the transmissive elements to one or more consumption points by means of at least one connector provided with at least three perforating elements.

7 Claims, 8 Drawing Sheets

MULTIPOLAR CABLE FOR TRANSMITTING ENERGY AND/OR SIGNALS, METHOD AND APPARATUS FOR THE PRODUCTION THEREOF

CROSS REFERENCE TO RELATED APPLICATION

This application is a national phase application based on PCT/IB2003/006407, filed Dec. 30, 2003, the content of which is incorporated herein by reference.

FIELD OF THE INVENTION

The present invention relates to a multipolar cable for transmitting energy and/or signals.

In particular, the present invention relates to a multipolar cable for transmitting energy and/or signals comprising:

at least three transmissive elements; and at least a sheath in a radially outer position with respect to said at least three transmissive elements, at least three longitudinal housings being defined in said sheath, said longitudinal housings being intended to house respectively said at least three transmissive elements according to a predetermined configuration.

The transmissive elements may be, for example, transmissive elements transmitting electrical energy and/or signals, possibly also optical signals. The signals, for example in the form of alternate electrical current at a given frequency, contain information which can be converted into operative instructions by means of conversion devices suitable for this purpose.

In the present description and in the following claims, the term "transmissive element" is used to indicate both a transmissive element transmitting electrical energy and/or signals, i.e. any element able to transmit electrical energy and/or signals (such as for example a metal conductor), and a mixed electro-optical transmissive element, i.e. any element able to transmit both electrical energy and an optical signal (such as for example a transmissive element comprising at least one metal conductor and at least one optical fibre, for example).

Depending on the nature of the transmissive elements, in addition to these, the cable may further comprise, for each transmissive element, at least one electrical insulating element and/or a containment element in a radially outer position with respect to the corresponding transmissive element. For example, the cable may further comprise at least one electrical insulating element arranged in a radially outer position with respect to an electrical energy transmissive element. Alternatively, the cable may further comprise at least one containment element (such as for example a tube, a sheath, a micro-sheath, a grooved core) arranged in a radially outer position with respect to an optical signal transmissive element. Alternatively, the cable may comprise both at least one electrical insulating element and at least one containment element arranged in a radially outer position with respect to a mixed electro-optical transmissive element.

The present invention relates to a cable provided with at least three transmissive elements as defined above, known in the art under the term of "multipolar cable". According to the above-mentioned definitions, the present invention relates not only to electrical multipolar cables for transporting or distributing energy, but also to multipolar cables of mixed energy/telecommunication type, comprising, in addition to one or more electrical energy transmissive elements, at least one optical fibre or a bundle of optical fibres.

Furthermore, the present invention relates to a method and to an extrusion apparatus for the production of a cable provided with a sheath incorporating at least three transmissive elements as defined above.

PRIOR ART

FIGS. 1 and 2 show a perspective and, respectively, a cross-sectional view of a multipolar cable 1 of the prior art for transmitting energy and/or signals. Such cable 1 is of the so-called openable type, in the sense that the same is produced with a cross-section having a substantially circular configuration and is provided with a longitudinal weakening line 7 which allows a localized opening of the cable 1 in order to impart to the same an open configuration, preferably flat, at a desired connection point, for example at a point connecting a given apparatus of an industrial automation line. In the above-mentioned figures, the multipolar cable 1 is shown in the open configuration for the connection to a suitable flat type connector perforating the insulation, which is schematically shown and generally indicated by reference number 8.

FIG. 9 shows a perspective view of the multipolar cable 1, which is shown in the closed configuration.

The multipolar cable 1, generally of the low voltage type (where low voltage refers to a voltage lower than approximately 1 kV), is normally used in industrial automation lines and, in any case, in applications where there is a need to transmit energy and/or signals to a plurality of consumption points, such as for example apparatus which require electrical supply and/or reception of input data in order to carry out a predetermined operation. From the radially innermost position towards the radially outermost position, the multipolar cable 1 comprises a plurality of transmissive elements 4, in the above-mentioned figures in number of five, and a protective sheath 5, in which a corresponding plurality of longitudinal housings 6, substantially parallel with each other, is defined.

In the above-mentioned figures, each transmissive element 4 is intended to transmit electrical energy and comprises, in particular, a conductor element 2 and an insulating layer 3 in a radially outer position with respect to said conductor element 2. The longitudinal housings 6, which are intended to house the above-mentioned plurality of transmissive elements 4, are formed within respective substantially tube-shaped longitudinal portions 30 of the cable which are reciprocally connected by longitudinal connecting portions 31. The sheath 5 is provided with a weakening line 7 arranged longitudinally with respect to the cable 1 and intended to facilitate the longitudinal opening of the cable 1. Once the cable 1 has been opened along such weakening line 7 at the desired connection point, for example in a position close to an industrial apparatus, the cable 1 assumes a flat configuration (FIG. 1) at such point. The flat portion of the cable 1 allows to transmit electrical energy and/or signals to at least one consumption point by means of the connector 8. The connector 8 comprises a plurality of metallic perforating elements 9 (pins), in a number equal to the number of energy transmission elements 4 arranged in the cable 1, which perforating elements 9 are reciprocally staggered by a distance substantially equal to the pitch between the conductor elements 2 of the cable 1 put in open configuration. As illustrated in the above-mentioned figures, the connector 8 comprises, in particular, a connector seat 10 provided with the above-mentioned perforating elements 9, which connector seat 10 cooperates with a closing element 11 associatable with said connector seat 10 through opposite projections 12 intended to be received in corresponding recesses 13 formed in the seat 10. Once the flat portion of the cable 1 has been positioned in the connector seat 10 (FIG. 1), the closing element 11 is pressed into the connector seat 10 (FIG. 2) in such a manner that the projections 12 are received in the recesses 13, and that the perforating elements 9 perforate the sheath 5 and the insulating layer 3 of the conductor elements 2, thus establishing an electrical contact between the perforating elements 9 and the conductor elements 2.

Examples of openable multipolar cables which can assume a flat configuration at the connection point are disclosed, for example, in patent DE-C1-101 19 653, in patent application DE-A1-40 04 229, and in patent application JP 2002216545.

Although the openable multipolar cables described above, shown for example in FIGS. 1 and 2, are suitable for the purpose, such cables have a number of disadvantages not yet overcome.

A first disadvantage is given by the fact that such type of openable cable, in the substantially circular cross-sectional closed configuration thereof, has an empty central portion which is not able to confer to the cable a sufficient resistance to possible compression forces and accidental impacts against the cable.

A further disadvantage is given by the fact that, in such type of openable cable, each electrical energy transmissive element, for example in the form of a metallic conductor, requires an insulating layer—arranged in a radially outer position with respect to the conductor—to avoid that the conductor remains without protection during the cable opening. The sheath of such type of cables, in fact, at the open portions of the cable assuming a flat configuration, may be damaged, and therefore may no longer be able to perform its protective function due to the stress to which the sheath is subject during the cable opening. Such stress may result in an undesirable tearing of the sheath which may leave the transmissive elements uncovered. This explains the above-mentioned need of insulating each transmissive element with a suitable insulating layer, resulting in an increase of the cable production time and costs. Furthermore, providing an individual insulating layer for each energy transmissive element leads to a disadvantageous increase of the cable size and weight, as well as a far more complicated method for producing the same.

A further disadvantage is in that the cable opening operation, adapted to confer to the cable a flat configuration at a given connection point, implies the risk of an undesirable propagation of the fracture along the cable even in portions of the latter which are not involved in the connecting operation. For such reason, suitable means, such as for example a box type containment element, must be provided in order to prevent the propagation of the cable fracture. In addition to the function of preventing the propagation of the fracture line along the cable, such containment element also carries out the function of protecting the connection area against the external environment.

Preconnectorized multipolar cables having a predetermined length, i.e. cable portions to at least one end of which a connector is provided, are also known. However, the purchase of said preconnectorized cables results in a waste of material and in an ensuing price increase, especially in order to manufacture lines of reduced length, since such cables are available on the market in a limited number of predetermined lengths which may exceed the length actually necessary for connection to a given apparatus.

SUMMARY OF THE INVENTION

The Applicant has found that it is possible to overcome the disadvantages of the prior art by forming the above-mentioned at least three housings of the sheath within respective substantially lobe-shaped longitudinal portions of the sheath.

In such a manner, by means of a suitable radial type connector, preferably substantially annular, having a radially inner profile mating the multi-lobed cable profile, it is advantageously possible to connect the cable to one or more consumption points without opening said cable and, therefore, without jeopardizing the protective action exerted by the sheath.

According to a first aspect thereof, the present invention relates to a multipolar cable for transmitting energy and/or signals comprising:

at least three transmissive elements, and a sheath in which at least three longitudinal housings are defined, said longitudinal housings being intended to house respectively said at least three transmissive elements according to a predetermined configuration and being formed within respective substantially lobe-shaped longitudinal portions of the sheath.

Thanks to these features and, in particular, thanks to the multi-lobed configuration of the sheath in which each lobe incorporates one transmissive element of the at least three transmissive elements, the cable of the present invention advantageously allows to connect the transmissive elements to at least one given consumption point, for example by means of a substantially annular connector provided with at least three perforating elements and arranged at the preselected connection point.

The multi-lobed configuration of the multipolar cable sheath of the invention, which is more compact than the configuration of the openable multipolar cable sheaths of the prior art, confers to the cable of the invention a greater mechanical resistance, in particular a greater resistance to compression forces (i.e. to crushing).

Furthermore, since the cable of the invention does not require opening operations to be connectorized, the sheath is not subject to undesirable stress during the cable opening step and therefore any risks of sheath tearing are eliminated.

Such advantageous effect of the cable of the invention in turn allows the sheath to be made of a material with adequate dielectric properties (in other words, with adequate electrical insulation properties), thus eliminating the need of individually insulating each transmissive element with a respective layer of insulating material. In this manner, therefore, the cable of the invention is more flexible with respect to the openable cables of the prior art, above all because, thanks to the absence of electrical insulation layers, the diameter of the cable of the invention is reduced. Furthermore, the provision of a sheath which also carries out the function of electrical insulation allows to attain considerable savings in materials and a reduction in production time and cost with respect to the openable cables of the prior art.

By way of illustrative example, the above-mentioned at least three transmissive elements may comprise at least three electrical conductor elements, each of said conductor elements for example including a plurality of conductor wires, for example made of copper.

Preferably, the multipolar cable of the invention comprises four transmissive elements, more preferably five transmissive elements.

According to a preferred embodiment of the invention, the cable is a three phase cable comprising three transmissive elements, for example three electrically conductive elements, housed in three respective longitudinal housings formed within an equal number of substantially lobe-shaped longitudinal sheath portions, as well as a further transmissive element acting as a neutral or ground element, said further transmissive element being housed in a further respective longitudinal housing formed in a respective longitudinal sheath portion. Preferably, said further transmissive element is positioned in a longitudinal housing arranged centrally to the cable.

Preferably, the predetermined configuration according to which the housings of the sheath and, consequently, the transmissive elements housed in the sheath are arranged, involves parallel and equidistant housings. Preferably, the transmissive elements are arranged centrally to the substantially lobe-shaped longitudinal sheath portions so that the transmissive elements are covered with a suitable thickness of sheath, with an ensuing advantageous optimization of the protective and insulating action exerted by the sheath in respect of the transmissive elements.

Preferably, the longitudinal housings are angularly staggered from each other by a predetermined angle. By way of illustrative example, in case the cable comprises three transmissive elements housed in an equal number of housings of the sheath, the transmissive elements preferably occupy the vertices of an equilateral triangle. In this manner, it is advantageously possible to provide a radial type connector, preferably circular in shape, comprising a radially inner portion having a multi-lobed configuration mating the multi-lobed shape of the sheath and a plurality of perforating elements directed radially inwards and adapted to penetrate the transmissive elements of the cable. In case the latter comprises three transmissive elements, the connector is provided with three perforating elements, preferably angularly staggered from each other by 120°.

In a similar manner, in a cable comprising four transmissive elements housed in an equal number of housings of the sheath, the transmissive elements preferably occupy the vertices of a square, while in a cable comprising five transmissive elements housed in an equal number of housings of the sheath, the transmissive elements preferably occupy the vertices of an equilateral pentagon. In this case the connector will comprise perforating elements arranged in a corresponding manner so as to perforate the respective transmissive elements.

Preferably, each substantially lobe-shaped longitudinal portion of the cable of the present invention has a sheath thickness which, at the radially innermost part of the substantially lobe-shaped longitudinal portion (in other words at the extrados of each transmissive element) is equal to at least 0.5 mm, more preferably between 0.5 and 2.0 mm and, still more preferably, between 0.7 and 1.5 mm.

According to a preferred embodiment of the cable of the invention, the substantially lobe-shaped longitudinal portions are reciprocally connected to each other by means of connecting portions having a predetermined bending radius.

Such a configuration permits a further advantageous saving in materials in the manufacture of the cable protective sheath.

Preferably, the longitudinal housings have a size such as to prevent any substantial relative movement of the transmissive elements in a plane perpendicular to the longitudinal direction of the cable.

Advantageously, such preferred embodiment ensures an optimized connection between the perforating elements of the connector and the transmissive elements, connection which is advantageously obtained after a substantially constant perforating stroke of the perforating elements within the cable.

Preferably, a further longitudinal housing is defined in the sheath, which further longitudinal housing is arranged centrally to the cable.

Preferably, said further longitudinal housing arranged centrally to the cable is intended to house a further transmissive element of the cable, such as for example a neutral or ground element.

Alternatively, said further longitudinal housing arranged centrally to the cable is intended to house a longitudinal reinforcing element of the cable which is able to ensure an adequate supporting action to the cable.

According to a preferred embodiment of the cable of the invention, the longitudinal housings, including the possible further longitudinal housing arranged centrally to the cable, have a substantially circular cross-section.

In the case of a cable comprising conductor elements having a cross-section equal to 4 $mm^2$, the housings provided in the cable sheath preferably have a diameter equal to about 2.5 mm. The possible central longitudinal housing intended to house, for example, the longitudinal reinforcing element, has a diameter preferably comprised between about 2 and about 4 mm.

Preferably, the sheath of the cable of the invention is provided with at least two identifying elements of the transmissive elements, said identifying elements being arranged at two adjacent substantially lobe-shaped longitudinal portions, in other words at the extrados of two adjacent transmissive elements.

Said identifying elements carry out the function of identifying in an univocal manner each of the two adjacent transmissive elements so marked, in other words the identifying elements allow to identify the correct sequence of the transmissive elements arranged in the cable in order to enable a correct positioning of the perforating elements of the connector on the cable.

Preferably, each of such identifying elements comprises at least one longitudinal groove.

Preferably, in order to identify the correct sequence (in other words the correct numeration) of the transmissive elements of the cable, the first transmissive element is identified by a first identifying element, for example comprising a single longitudinal groove formed at a first substantially lobe-shaped longitudinal portion of the sheath, while the second transmissive element is identified by a second identifying element, for example comprising two longitudinal grooves formed at a second substantially lobe-shaped longitudinal portion of the sheath adjacent to the above-mentioned first longitudinal portion.

As an alternative to said preferred embodiment according to which the identifying elements are differentiated on the basis of the number of longitudinal grooves, the identifying elements of the first, and respectively, of the second transmissive element, may be differentiated in a different manner, for example by providing grooves having different depths, widths or geometry.

According to a second aspect thereof, the present invention relates to a method for the production of a multipolar cable for transmitting energy and/or signals of the type comprising:

a plurality of transmissive elements; and a sheath in which a plurality of longitudinal housings is defined, said longitudinal housings being intended to house respectively said plurality of transmissive elements according to a predetermined configuration;

said method comprising the steps of:

providing said plurality of transmissive elements according to said predetermined configuration;

feeding said plurality of transmissive elements to an extrusion head; and extruding said sheath around said plurality of transmissive elements maintaining said plurality of transmissive elements in said predetermined configuration;

wherein, during said extrusion step, said transmissive elements are moved forward within a plurality of guiding ducts coaxially housed in a female die, said guiding ducts being arranged according to said predetermined configuration.

In other words, the above-mentioned extrusion step includes the conveying of the sheath material being extruded along an extrusion path defined within an interspace obtained between said female die, acting as extrusion matrix or die, and said plurality of guiding ducts.

Thanks to such features of the method of the invention and, in particular, thanks to the fact that the sheath material of the cable is extruded around said guiding ducts of the transmissive elements for a portion of predetermined length, the transmissive elements are conveniently enclosed by the material being extruded without being crushed by the sheath material under pressure, i.e. advantageously maintaining the required reciprocal distance depending on the preselected configuration until the extruded material is in plastic state.

Furthermore, the method of the invention advantageously allows to produce in a substantially continuous manner two different types of multipolar cable, namely both the multi-lobed multipolar cable of the present invention described above, and, as described in a more detailed manner in the following, the openable multipolar cable of the prior art illustrated in FIGS. 1 and 2, i.e. a cable having a substantially circular cross-section which is able to be opened and to assume a flat configuration at least one connection point.

Preferably the guiding ducts are equidistant from each other and reciprocally spaced by a predetermined distance.

Preferably, the guiding ducts are angularly staggered from each other by a predetermined angle.

According to a preferred embodiment of the method of the invention, the guiding ducts are in number of three. Advantageously, such preferred embodiment of the method of the invention allows to produce a cable comprising three transmissive elements.

In case the guiding ducts are in number of three, these are preferably arranged so as to occupy the vertices of an equilateral triangle.

In order to produce a multipolar cable according to the present invention, the female die in which the above-mentioned plurality of guiding ducts is axially housed comprises a first portion including a multi-lobed radially inner wall having a predetermined length so as to form a sheath comprising a plurality of substantially lobe-shaped longitudinal portions.

According to a preferred embodiment of the method of the invention, at least two adjacent lobes of the first portion of the female die are provided with respective longitudinal protrusions so as to form a sheath provided with corresponding longitudinal grooves (the above-mentioned identifying elements) at two adjacent substantially lobe-shaped longitudinal portions.

The above-mentioned extrusion step is preferably carried out so as to form a further longitudinal housing in said sheath which is arranged centrally to the cable.

According to a first preferred embodiment, the method comprises the further steps of providing and feeding a further longitudinal reinforcing element to said extrusion head, the further longitudinal reinforcing element being intended to be housed in said further longitudinal housing arranged centrally to the cable.

According to a second alternative preferred embodiment, the method of the invention comprises the further steps of providing and feeding a neutral or ground element to said extrusion head, the neutral or ground element being intended to be housed in said further longitudinal housing arranged centrally to the cable.

The above-mentioned extrusion step is preferably carried out so as to form a sheath comprising at least three housings angularly staggered by a predetermined angle, such housings being respectively formed at the above-mentioned three substantially lobe-shaped longitudinal portions of the sheath.

Preferably, the above-mentioned three substantially lobe-shaped longitudinal portions of the sheath are reciprocally connected by connecting portions having a predetermined bending radius.

In case the method of the invention is carried out in order to produce an openable multipolar cable of the prior art, for example of the type shown in FIGS. 1 and 2, a flow shutter element is positioned among said guiding ducts to define a plurality of first interspaces between said flow shutter element and each of said guiding ducts and a second interspace, substantially annular, between said flow shutter element and said first portion of the female die.

Thanks to the provision of such a flow shutter element, the material being extruded is advantageously deviated towards the above-mentioned plurality of first interspaces and the above-mentioned second interspace so as to form the openable multiple core cable described above.

Preferably, the flow shutter element has a shape substantially mating said plurality of guiding ducts and said first portion of the female die.

In this manner, an openable cable of the prior art is advantageously formed, which cable comprises a sheath including a plurality of housings formed within respective substantially tube-shaped longitudinal cable portions, said substantially tube-shaped longitudinal portions being reciprocally connected by longitudinal connecting portions. The substantially tube-shaped longitudinal cable portions are in fact produced by extrusion of an extrudable material through the above-mentioned plurality of first interspaces, while the longitudinal connecting portions are produced by extrusion of said extrudable material through the above-mentioned second substantially annular interspace.

In case the guiding ducts have a substantially circular cross-section, the substantially tube-shaped longitudinal sheath portions are provided with a substantially circular cross-section.

Preferably, the above-mentioned plurality of first interspaces has a substantially constant thickness. Preferably, the above-mentioned second interspace also has a substantially constant thickness. Preferably, the first interspaces and the second interspace have the same thickness: in this manner, it is advantageously possible to produce a sheath of the above-mentioned type in which the substantially tube-shaped longitudinal cable portions have a substantially constant thickness.

Preferably, the thickness of the first interspaces is comprised between about 0.3 and about 1.0 mm and the thickness of the substantially annular interspace is comprised between about 0.5 and about 2.0 mm. In this manner, it is advantageously possible to produce an openable cable in which the longitudinal housings of the transmissive elements are formed in substantially tube-shaped longitudinal portions of a sheath having a preferably constant thickness, preferably between about 0.3 and about 1.0 mm, the substantially tube-shaped longitudinal portions being reciprocally connected by connecting portions having a predetermined bending radius and a thickness between about 0.5 and 2.0 mm.

Preferably, the above-mentioned flow shutter element is mounted flush with the free end of the guiding ducts.

Preferably, such flow shutter element has a shorter length than the guiding ducts, preferably substantially equal to the length of the above-mentioned first portion of the female die. In the case in which, as described in more detail in the following, the guiding ducts are part of a first portion of a male die of the extrusion head and are received in a plurality of longitudinal cavities formed in a second portion of the male die so as to protrude for a portion of predetermined length from the second portion of the male die, the male die being coaxially mounted within the female die around a same longitudinal axis substantially parallel to the conveying direction of the transmissive elements, the flow shutter element has a length preferably equal to about 30-60% of the length of the portions of guiding ducts extended externally to the second portion of the male die.

The flow shutter element is preferably longitudinally tapered in an opposite direction with respect to the extrusion direction so as to facilitate the convey of the material to be extruded within the above-mentioned plurality of first interspaces.

In case the method is carried out in order to produce the openable cable of the prior art, the female die is preferably provided with at least one longitudinal protrusion positioned in an intermediate zone between two adjacent guiding ducts, such longitudinal protrusion being intended to form a respective weakening line of the cable sheath, in particular of the longitudinal connecting portions of the sheath, to open the sheath.

According to a preferred embodiment of the method of the invention, this includes a further preliminary step of extruding an insulating layer on the transmissive elements before the latter are fed to the extrusion head.

Such embodiment of the method of the invention is particularly preferred in case the method of the invention is intended to produce the openable cable of the prior art, so as to maintain the transmissive elements isolated even when the sheath is subject to undesirable tearing as a result of an opening operation along the above-mentioned weakening line.

According to a third aspect thereof, the present invention relates to extrusion apparatus for the production of a multipolar cable for transmitting energy and/or signals of the type comprising:

a plurality of transmissive elements; and a sheath in which a plurality of longitudinal housings is defined, said longitudinal housings being intended to house respectively said plurality of transmissive elements according to a predetermined configuration;

said apparatus comprising an extrusion head including a male die and a female die coaxially mounted between each other around a same longitudinal axis substantially parallel to the conveying direction of said transmissive elements, said male die comprising a first portion including a plurality of guiding ducts arranged according to said predetermined configuration, and said female die comprising a first portion coaxially mounted around said plurality of guiding ducts.

According to a preferred embodiment of the apparatus of the invention, the above-mentioned first portion of the male die comprises at least three guiding ducts of predetermined length, preferably arranged parallel to said longitudinal axis and preferably angularly staggered from each other by a predetermined angle.

Preferably, the guiding ducts have a substantially circular cross-section.

In case the cross-section of each conductor element of the cable is equal to 4 $mm^2$, the inner diameter of said guiding ducts is preferably equal to about 2.8 mm.

Preferably, the male die of the apparatus of the invention further comprises a second portion (for coupling the male die with a supporting element) within which a plurality of longitudinal cavities is defined, said longitudinal cavities being arranged according to said predetermined configuration and being intended to receive the plurality of guiding ducts described above. According to a preferred embodiment of the apparatus of the invention, the guiding ducts are inserted within such cavities of the male die and partially protrude in a cantilevered manner from the male die.

According to a preferred embodiment of the apparatus of the invention, the above-mentioned ducts—in the portion protruding in a cantilevered manner from the male die thereof—have a length between about 5 and about 20 mm.

According to a preferred embodiment of the apparatus of the invention, the above-mentioned second portion comprises a first cylindrical section and a second truncated-cone section.

Advantageously, the first cylindrical section of the male die ensures the coupling of the latter with a supporting element, while the second truncated-cone section allows to obtain an uniform distribution of the material to be extruded and a suitable flow of the same towards the guiding ducts of the transmissive elements, as well as an improved advancement of the material between the interspaces defined among the guiding ducts of the transmissive elements.

Preferably, the longitudinal cavities of the male die are in number of three.

The longitudinal cavities of the male die are preferably parallel to each other and angularly staggered from each other by a predetermined angle.

Alternatively, such cavities are convergent with each other in the direction of exit of the material to be extruded from the male die. Preferably, the direction perpendicular to the base surface of the cylindrical section and the axis of said cavities form an angle comprised between about 10° and 30°.

Preferably, the female die comprises a first portion including a multi-lobed radially inner wall so as to form a sheath comprising a plurality of substantially lobe-shaped longitudinal portions. In this manner, it is advantageously possible to use the apparatus of the invention to produce the multi-lobed multipolar cable of the invention.

Preferably, the first portion of the female die has a predetermined length, preferably equal to about 50% of the length of the portions of guiding ducts protruding in a cantilevered manner from the male die and, still more preferably, comprised between about 2.0 and 10 mm.

Preferably, the first portion of the male die further comprises a flow shutter element positioned among said guiding ducts as described above with reference to the method of the invention. Preferably, the flow shutter element of the male die has a shape substantially mating said guiding ducts and said first portion of the female die.

In this manner, the longitudinal housings receiving the transmissive elements are formed in substantially lobe-shaped longitudinal sheath portions.

Preferably, the flow shutter element longitudinally extends from said second portion of the male die.

Said first interspaces, which are defined between said flow shutter element and said guiding ducts, and said second interspace, which is defined between the flow shutter element and the first portion of the female die, preferably have a constant thickness, more preferably the same thickness.

Preferably, the flow shutter element is mounted flush with the free end of the guiding ducts.

Preferably, the flow shutter element has a shorter length than the portions of guiding ducts protruding from the male die.

The flow shutter element is preferably longitudinally tapered in an opposite direction with respect to the extrusion direction, so as to facilitate the convey of the material to be extruded within the above-mentioned plurality of first interspaces.

According to a preferred embodiment of the apparatus of the invention, the female die is provided with at least one longitudinal protrusion arranged in an intermediate zone between two adjacent ducts, such longitudinal protrusion being intended to form a respective longitudinal weakening line of said longitudinal connecting portions to allow the opening of the sheath.

Preferably, in the second portion of the male die, a further central cavity may be provided having a longitudinal direction substantially coinciding with the longitudinal direction of the male die, such further cavity being preferably intended to receive a longitudinal reinforcing element of the cable.

In case no longitudinal reinforcing element is included in the sheath, the central longitudinal cavity of the second section of the male die is preferably closed by means of a closing element, which is preferably tapered in the extrusion direction.

In this manner, the flexibility of the extrusion apparatus is advantageously increased, in the sense that the same apparatus is able to produce both a cable in the sheath of which a longitudinal central housing is defined, as well as, once the above-mentioned closing element is inserted in the longitudinal central cavity of the second section of the male die, a cable comprising a longitudinal central solid portion, i.e. devoid of such central housing.

Preferably, the apparatus of the invention further comprises a spacer positioned upstream of the extrusion head, which is intended to arrange said plurality of transmissive elements according to the predetermined configuration.

BRIEF DESCRIPTION OF THE FIGURES

Additional features and advantages of the invention will become more readily apparent from the description of some embodiments of a method for the production of a multipolar cable according to the invention, made with reference to the attached drawing figures in which, for illustrative and non limiting purposes, an apparatus for carrying out said method is shown.

In the drawings.

DETAILED DESCRIPTION OF THE PREFERRED EMBODIMENTS

Figure 3:
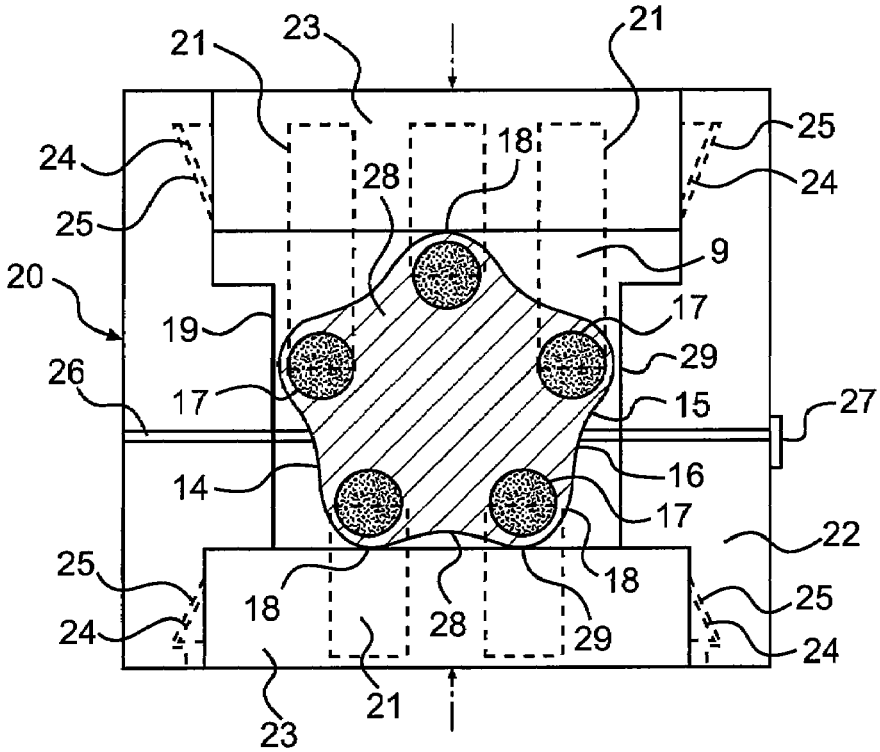
FIG. 3 is a cross-sectional view of a preferred embodiment of a multipolar cable of the present invention, shown in working condition together with a connector of the type perforating the insulation.
Figure 6:
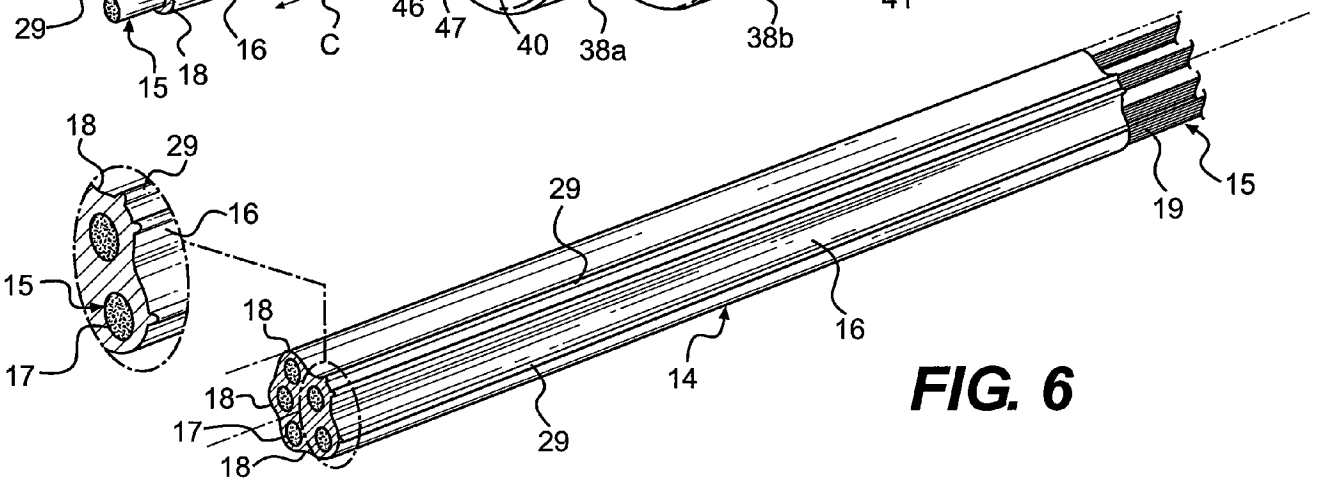
FIG. 6 is a perspective view of the cable of FIG. 3.

With reference to FIGS. 3 and 6, a multipolar cable for transmitting energy and/or signals according to a preferred embodiment of the invention is generally indicated by 14. In FIG. 3, the multipolar cable 14 is shown in working condition together with a connector of the type perforating the insulation, generally indicated by 20, which is described in greater detail in the following of the present description.

The multipolar cable 14 is in particular intended for transmitting energy and/or signals to one or more apparatus of an industrial automation line. In particular, although only a single connector 20 is shown in FIG. 3, more than one connector can be associated to the cable 14, the connectors being longitudinally staggered from each other and arranged at more connection points.

According to the preferred embodiment shown in the above-mentioned figures, the multipolar cable 14 comprises:

five transmissive elements 15; and a sheath 16 in which five longitudinal housings 17 are defined, said longitudinal housings 17 being intended to house respectively the above-mentioned transmissive elements 15 according to a predetermined configuration;

wherein the housings 17 are formed within respective substantially lobe-shaped longitudinal portions 18 of the sheath 16.

In FIG. 3 the transmissive elements 15 are intended to transmit electrical energy and/or signals, and in particular include conductor elements 19, each one of said conductor elements 19 comprising a plurality of conductor wires, for example made of copper.

The multipolar cable 14 is therefore able to transmit energy and/or signals by means of the connector 20 to one or more consumption points, in the example shown in FIG. 3 to an apparatus arranged along an industrial automation line.

The sheath 16 may be made of a polymeric material, for example selected from the group comprising: polyolefins, copolymers of different olefins, copolymers of olefins with esters having an ethylene unsaturation, polyesters, polyethers, copolymers polyether/polyester, and mixtures thereof.

Examples of such polymers are: high density polyethylene (HDPE) (with a density d=0.940-0.970 g/cm$^3$), medium density polyethylene (MDPE) (d=0.926-0.940 g/cm$^3$), low density polyethylene (LDPE) (d=0.910-0.926 g/cm$^3$); ethylene and alpha-olefin copolymers having from 3 to 12 carbon atoms (for example 1-butene, 1-esene, 1-octene, and similars), linear low density polyethylene (LLPDE) and ultra low density polyethylene (ULDPE) (d=0.860-0.910 g/cm$^3$); polypropylene (PP); polypropylene thermoplastic copolymers with other olefins, in particular ethylene; copolymers of ethylene and at least one ester selected from alkylacrylates, alkylmethacrylates and vinylcarboxylates, wherein the alkyl group—linear or branched—may have between 1 and 8, preferably between 1 and 4, carbon atoms, wherein the carboxyl group—linear or branched—may have between 2 and 8, preferably between 2 and 5 carbon atoms, in particular ethylene/vinylacetate copolymers (EVA), ethylene/ethylacrylate copolymers (EEA), ethylene/butylacrylate copolymers (EBA); ethylene/alpha-olefin elastomer copolymers (such as for example ethylene/propylene copolymers (EPR), ethylene/propylene/diene (EPDM), and mixtures thereof); and mixtures thereof.

Preferably, the polymer base is filled with a mineral filler, such as for example magnesium and/or aluminum hydroxide or hydrate hydroxide.

In the embodiment shown in FIGS. 3 and 6, the predetermined configuration according to which the housings 17 of the sheath 16 and, consequently, the transmissive elements 15 housed in the sheath 16 are arranged, consists of a configuration wherein the housings are parallel and equidistant from each other. In particular, each housing 17 is arranged in a central portion of a respective substantially lobe-shaped longitudinal portion 18 of the sheath 16. In this manner, the transmissive elements 15 are covered with a suitable thickness of sheath 16 at the radially innermost part of the longitudinal portions 18. In case of a multipolar cable 14 having five transmissive elements 15 in which the cross-sectional area of each conductor element 19 is equal to 4 $mm^2$, the maximum diameter of the cable is comprised between about 12 and about 18 mm, preferably between about 13 and about 15 mm. Preferably, the thickness of the sheath at the extrados is comprised between about 0.5 and about 2.0 mm, more preferably between about 0.7 and about 1.5 mm.

In particular, the housings 17 are angularly staggered by a predetermined angle, which in the illustrated embodiment is equal to about 72°. In other words, in the illustrated embodiment shown in FIGS. 3 and 6, in which the multipolar cable 14 comprises five transmissive elements 15 housed in an equal number of housings 17 in the sheath 16, the transmissive elements 15 occupy the vertices of an equilateral pentagon.

In the preferred embodiment shown in the above-mentioned figures, in the case of a multipolar cable 14 in which the cross-sectional area of each conductor element 19 is equal to 4 $mm^2$, the housings 17 have a substantially circular section having a diameter equal to about 2.5 mm, substantially equal to the maximum diameter of the transmissive elements 15.

The substantially lobe-shaped longitudinal portions 18 are reciprocally connected by connecting portions 28 having a predetermined bending radius which, in the case of a multipolar cable 14 comprising five transmissive elements 15 in which the cross-sectional area of each conductor element 19 is equal to 4 $mm^2$, is for example comprised between about 2 and about 4 mm, preferably between about 3 and about 3.5 mm.

In order to identify two specific transmissive elements 15 housed in two respective adjacent longitudinal housings 17, the sheath 16 of the multipolar cable 14 is provided with two identifying elements of the transmissive elements 15, both indicated by 29, which are arranged at two adjacent substantially lobe-shaped longitudinal portions 18 of the sheath 16. In particular, a first identifying element 29 comprises a longitudinal groove and a second identifying element 29 comprises two longitudinal grooves.

Figure 10:
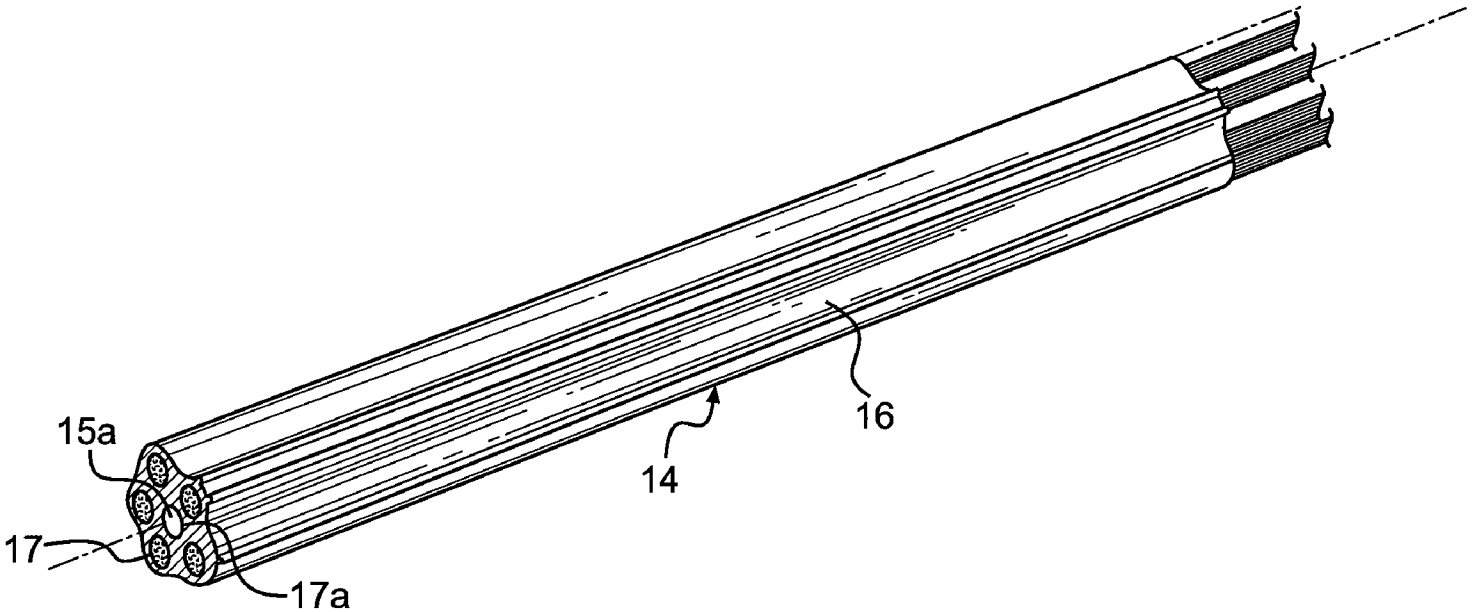
FIG. 10 is a perspective view of one embodiment of a multipolar cable described herein.

In another embodiment, depicted in FIG. 10, a further longitudinal housing 17*a* can be defined in sheath 16, which further longitudinal housing can be arranged centrally to cable 14. In one embodiment, further longitudinal housing 17*a* can house a further transmissive element 15*a* of cable 14, such as, for example, a neutral or ground element. Alternatively, in another embodiment, further longitudinal housing 17*a* can house a longitudinal reinforcing element of cable 14 which can ensure an adequate supporting action to the cable.

Similarly to what has been described with reference to the openable multipolar cable 1 of the prior art shown in FIG. 1, in order to allow the transmission of energy and/or signals to one or more consumption points in an industrial automation line, the multipolar cable 14 is connected to such consumption points by means of the connector 20 schematically shown in FIG. 3. In particular, the connector 20 comprises a plurality of metallic perforating elements 21, in a number equal to the number of the conductor elements 19 provided in the cable 14, such perforating elements 21 being arranged so as to perforate the conductor elements 19.

As schematically shown in FIG. 3, the connector 20 comprises in particular a connector seat 22 provided with the above-mentioned perforating elements 21. The connector seat 22 has a substantially square cross-section, which can be opened by means of a hinge 26 and locked by means of a clamp 27 on the opposite side which is adapted to close the connector 20 around the multipolar cable 14. In particular, the radially inner portion of the connector seat 22 has a multi-lobed shape mating the multi-lobed shape of the sheath 16, and cooperates with a pair of closing elements 23 which can be associated in opposite positions to the connector seat 22 by means of a respective pair of protrusions 24 intended to be received into a corresponding pair of recesses 25 formed in the connector seat 22.

Once the multipolar cable 14 has been positioned in the connector seat 22, the closing elements 23 are pressed against the connector seat 22, so that the protrusions 24 are received by the recesses 25 and the perforating elements 21 penetrate the sheath 16 so as to establish an electrical contact between the perforating elements 21 and the conductor elements 19. Once the connecting operation described above has been completed, the clamp 27 is tightened to maintain the connector 20 closed in a stable manner around the multipolar cable 14.

Thanks to the type of connection illustrated above, contrarily to the openable multipolar cables of the prior art, the multipolar cable 14 of this invention has not to be opened (because the same has not to assume a flat configuration in order to be coupled with a connector), thus eliminating both the risk of tearing the sheath, and the need of individually insulating each transmissive element with a respective insulating layer.

Figure 4:
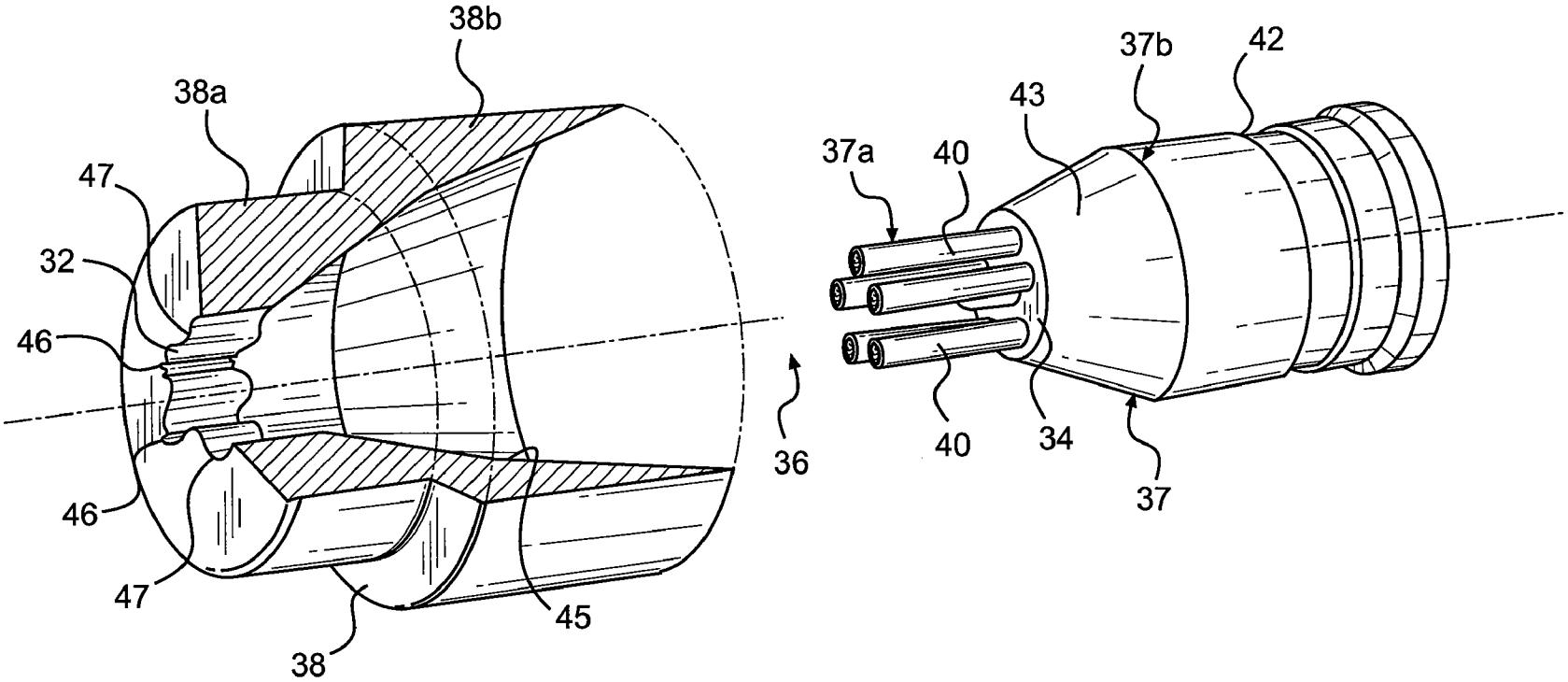
FIG. 4 is an exploded view, partially in cross-section, of a first preferred embodiment of an extrusion apparatus according to the invention for the production of the cable of FIG. 3.
Figure 5:
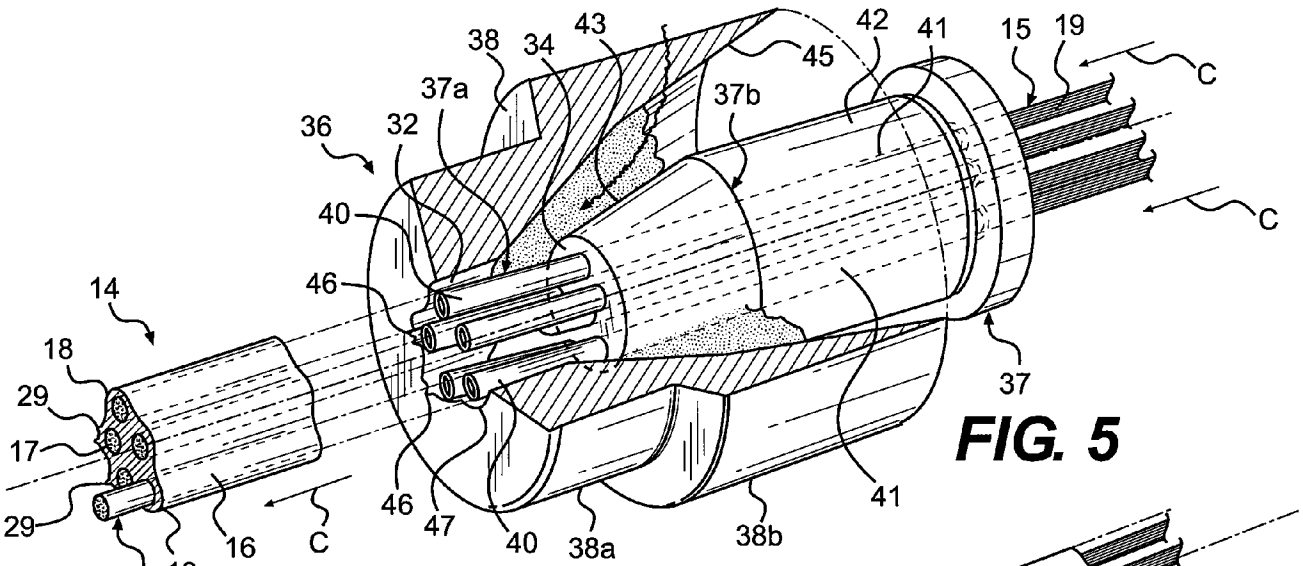
FIG. 5 is a perspective view, partially in cross-section, of the extrusion apparatus of FIG. 4.

With reference to FIGS. 4 and 5, these show a first preferred embodiment of the extrusion apparatus according to the invention for the production of the multipolar cable 14 for transmitting energy and/or signals shown in FIG. 3.

The extrusion apparatus comprises an extrusion head, generally indicated by 36 in the above-mentioned figures, which is fed with a mixture intended to form the sheath by means of an extruder screw, not shown as conventional per se.

The extrusion head 36 comprises a male die 37 and a female die 38 coaxially mounted between each other around a same longitudinal axis substantially parallel to the conveying direction of the transmissive elements 15, which conveying direction is indicated by arrows C.

The male die 37 comprises a first portion 37*a* including a plurality of guiding ducts (all indicated by 40) for guiding the transmissive elements 15 and a second portion 37*b* intended, as described in more detail in the following, to couple the male die 37 to a supporting element, not shown as conventional per se, and to radially distribute the material being extruded.

The guiding ducts 40 are arranged according to the above-mentioned predetermined configuration so as to house the transmissive elements 15 in such configuration. In this manner, by feeding the material intended to form the sheath 16 around the transmissive elements 15 advancing along the above-mentioned guiding ducts 40, the formation of the above-mentioned longitudinal housings 17 arranged according to the above-mentioned predetermined configuration is ensured, while preventing that the material being extruded crushes the transmissive elements 15 due to the pressure to which the material is subject.

In particular, the material intended to form the sheath 16 is extruded along an extrusion direction substantially parallel to the above-mentioned conveying direction C of the transmissive elements 15.

According to the preferred embodiment of the apparatus of the invention shown in FIGS. 4 and 5, intended to produce the multipolar cable 14 of FIG. 6, the first portion 37*a* of the male die 37 comprises five guiding ducts 40 arranged parallel to the above-mentioned longitudinal axis and angularly staggered by about 72°.

In the case a multipolar cable 14 in which the cross-sectional area of each conductor element 19 is equal to 4 mm, the guiding ducts 40 shown in the above-mentioned figures have a substantially circular cross-section having an inner diameter preferably equal to about 2.8 mm.

According to the preferred embodiment illustrated, the guiding ducts 40 protrude from the second portion 37*b* of the male die 37, in particular from the wall 34 of the male die 37, said wall 34 being substantially perpendicular to the extrusion direction.

The guiding ducts 40 have a predetermined length depending on the viscosity of the material to be extruded, which in turn depends on the temperature at which the extrusion is performed. By way of illustrative example, in case a polymer material comprising ethylene-vinyl-acetate filled with aluminum hydroxide is extruded, the extrusion temperature is equal to about 170° and the length of the portions of guiding ducts 40 protruding from the second portion 37*b* of the male die 37 is comprised between about 5 and about 20 mm.

A plurality of longitudinal cavities 41 arranged according to the above-mentioned predetermined configuration and intended to support the guiding ducts 40 is defined within the second portion 37*b* of the male die 37. For this purpose, the guiding ducts 40 are inserted within such cavities 41 of the male die 37, and partially protrude in a cantilevered manner from the male die 37. Therefore, according to the preferred embodiment illustrated, the longitudinal cavities 41 have a substantially circular cross-section, are in number of five, are arranged at equal distance from and parallel to the above-mentioned longitudinal axis, and angularly staggered by about 72°. The distance between two adjacent longitudinal cavities 41 of the second portion 37*b* of the male die 37 is substantially equal to the above-mentioned distance between two adjacent guiding ducts 40.

The second portion 37*b* of the male die 37 preferably comprises a first cylindrical section 42, intended to be coupled with a supporting element, not shown as conventional per se, on the male die 37, and a second truncated-cone section 43, intended to facilitate the convey of the material being extruded towards the guiding ducts 40 of the transmissive elements 15.

The female die 38 comprises a first portion 38*a* and a second portion 38*b* intended to receive the first portion 37*a* and, respectively, the second portion 37*b* of the male die 37.

In order to produce the multipolar cable 14 described above, the first portion 38*a* of the female die 38 comprises a multi-lobed radially inner wall 32. In particular, in order to produce the sheath 16 comprising the above-mentioned five substantially lobe-shaped longitudinal portions 18, the radially inner wall 32 of the first portion 38*a* of the female die 38 comprises five lobes 47.

A cavity 45 intended to receive the above-mentioned second portion 37*b* of the male die 37 is defined in the second portion 38*b* of the female die 38.

In this manner, an extrusion path is defined between the male die 37 and the female die 38, the extrusion path comprising a first passage defined between the truncated-cone section 43 of the second portion 37*b* of the male die 37 and the second portion 38*b* of the female die 38, and a second passage defined between the first portion 37*a* of the male die 37 and the first portion 38*a* of the female die 38.

The first portion 38*a* of the female die 38 has a predetermined length, preferably equal to about 50% of the length of the portions of guiding ducts 40 protruding from the second portion 37*b* of the male die 37. Preferably, such length is comprised between about 2 and about 10 mm.

In order to form the above-mentioned identifying elements 29 in the form of grooves on the sheath 16 of the multipolar cable 14, the first portion 38*a* of the female die 38 is provided with longitudinal protrusions 46 at two adjacent lobes 47 of the first portion 38*a* of the female die 38.

With reference to the apparatus described above, a first preferred embodiment of the method according to the invention for the production of the multipolar cable 14 for transmitting energy and/or signals of the above-mentioned type, includes the following steps.

According to a first step of the method of the invention, the five transmissive elements 15 are provided according to the preselected configuration.

According to a second step of the method of the invention, such transmissive elements 15 are fed to said extrusion head 36, in particular said transmissive elements 15 are fed into the guiding ducts 40 which are partially inserted in the cavities 41 of the male die 37 of the extrusion head 36.

Subsequently, an extrudable material is extruded around the transmissive elements 15 to form the sheath 16 maintaining the transmissive elements 15 in the above-mentioned predetermined configuration, the entry of said material being provided at the intersection between the first cylindrical section 42 and the second truncated-cone section 43 of the second portion 37*b* of the male die 37.

More in particular, the material to be extruded is made to flow along the first passage of the extrusion path defined between the truncated-cone section 43 of the second portion 37*b* of the male die 37 and the second portion 38*b* of the female die 38, so as to distribute the material in a uniform manner and to make the same flow along the second truncated-cone section 43 towards the ducts 40 guiding the transmissive elements 15.

The material is then made to flow along the second passage of the extrusion path defined between the first portion 37*a* of the male die 37 and the first portion 38*a* of the female die 38, i.e. defined between the plurality of guiding ducts 40 and the first portion 38*a* of the female die 38.

According to the method of the invention, during the above-mentioned extrusion step the five transmissive elements 15 are conveyed within the five guiding ducts 40.

In this manner, the transmissive elements 15 are encased within the longitudinal housings 17 formed in the sheath 16 according to the predetermined configuration, to form the multipolar cable 14 of the invention.

Figure 1:
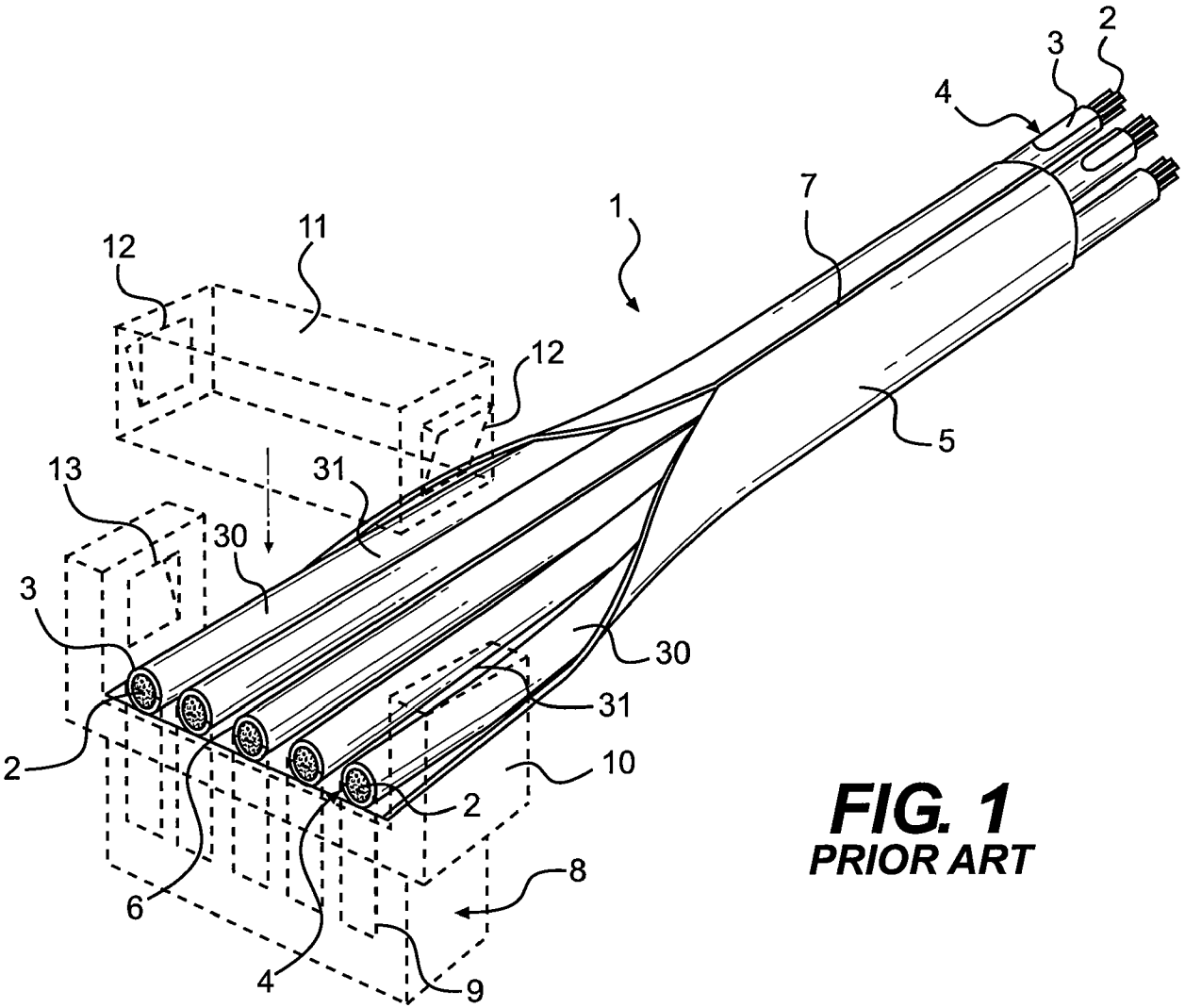
FIG. 1 PRIOR ART
FIG. 1 is a perspective view of an openable multipolar cable of the prior art, shown in open configuration in operative working condition together with a connector of the type perforating the insulation.
Figure 2:
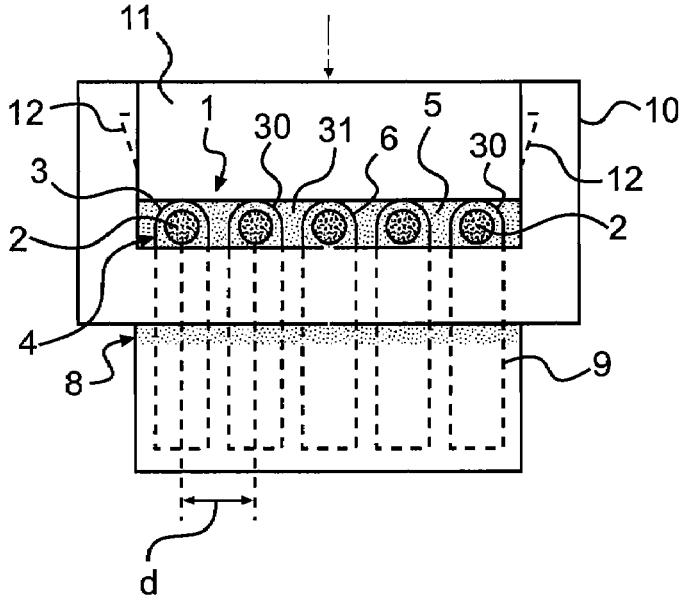
FIG. 2 PRIOR ART
FIG. 2 is a cross-sectional view of the cable of FIG. 1 in open configuration.
Figure 7:
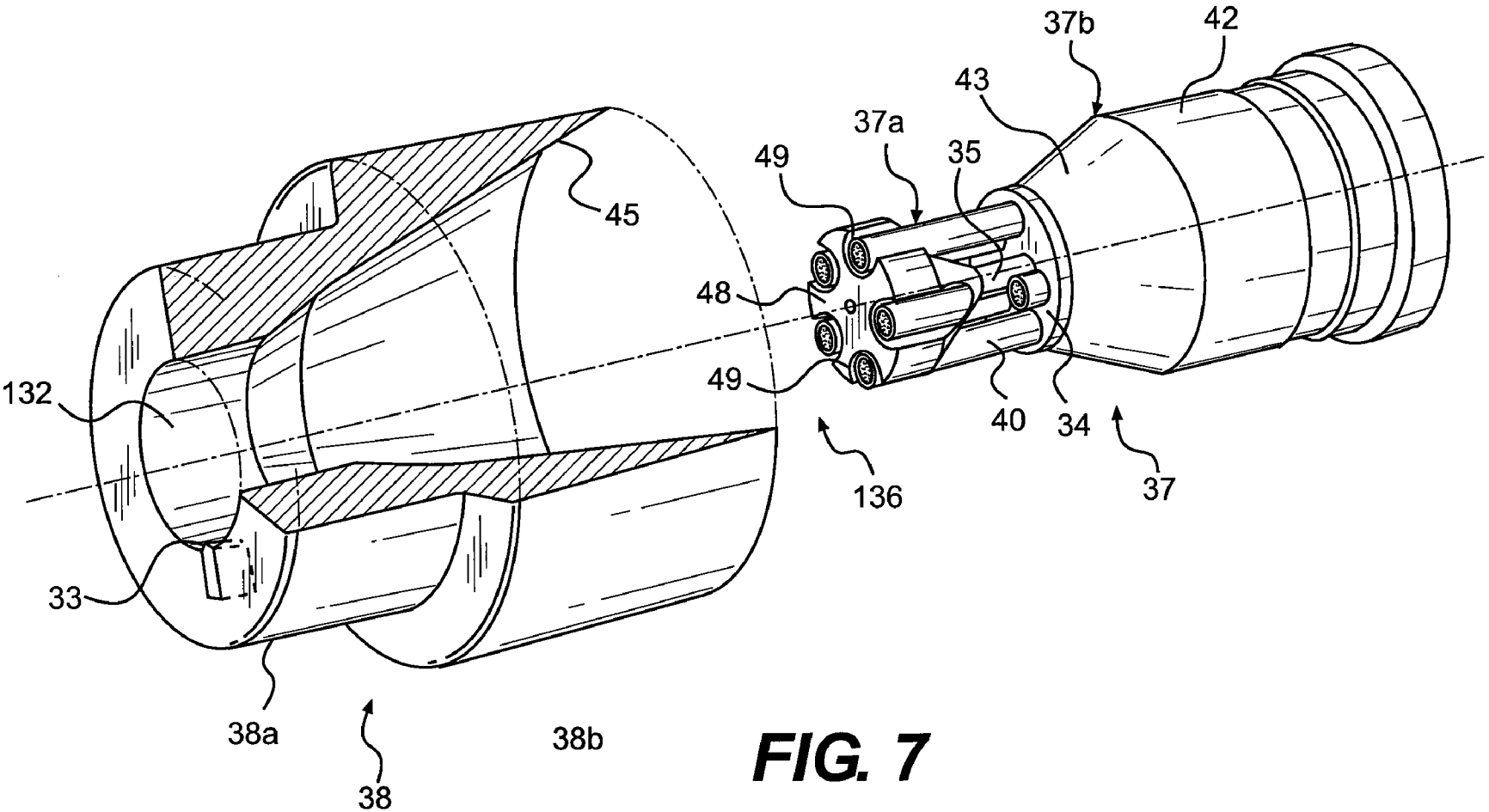
FIG. 7 is an exploded perspective view, partially in cross-section, of a second preferred embodiment of an extrusion apparatus according to the invention for the production of the openable cable of FIG. 1.
Figure 8:
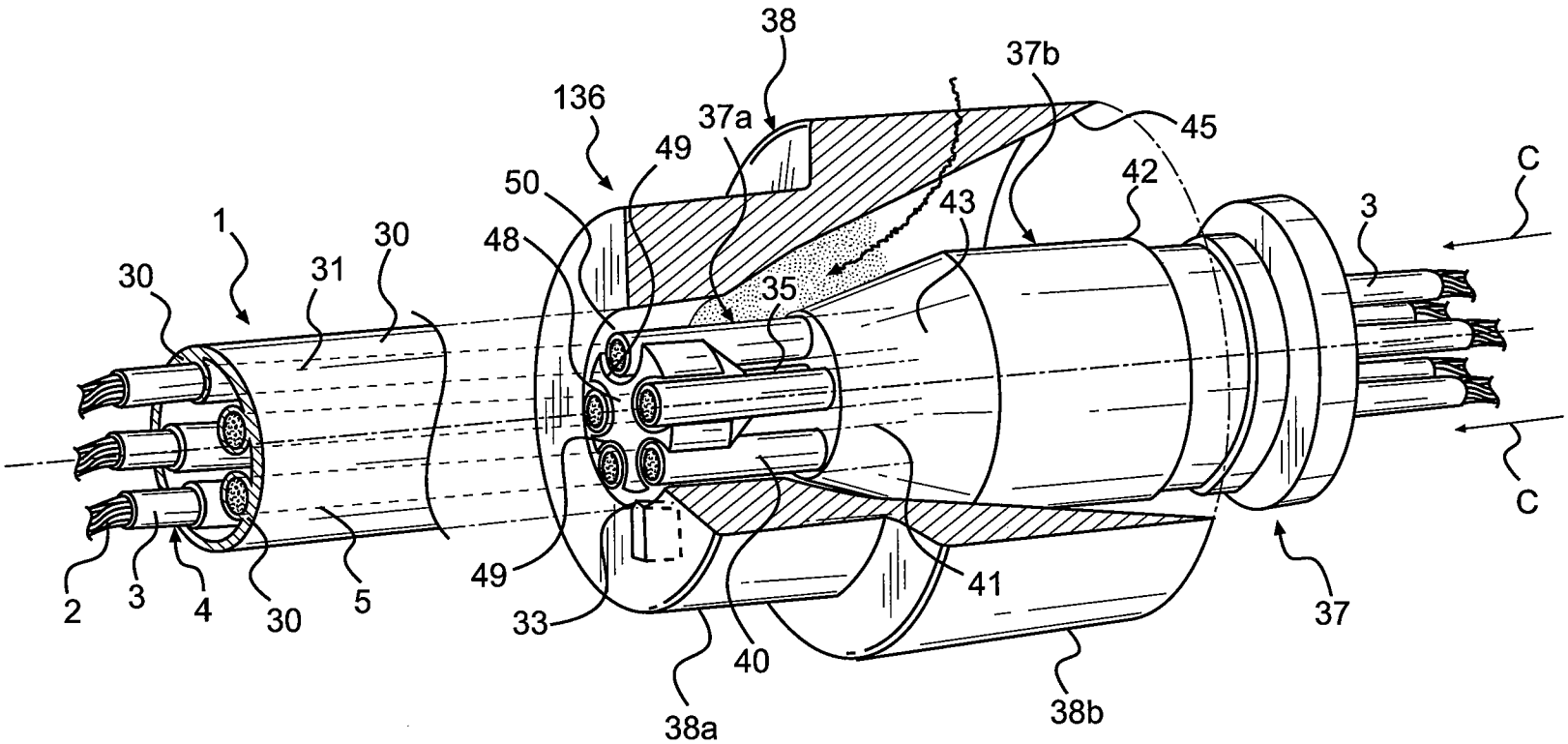
FIG. 8 is a perspective view of the extrusion apparatus of FIG. 7.
Figure 9:
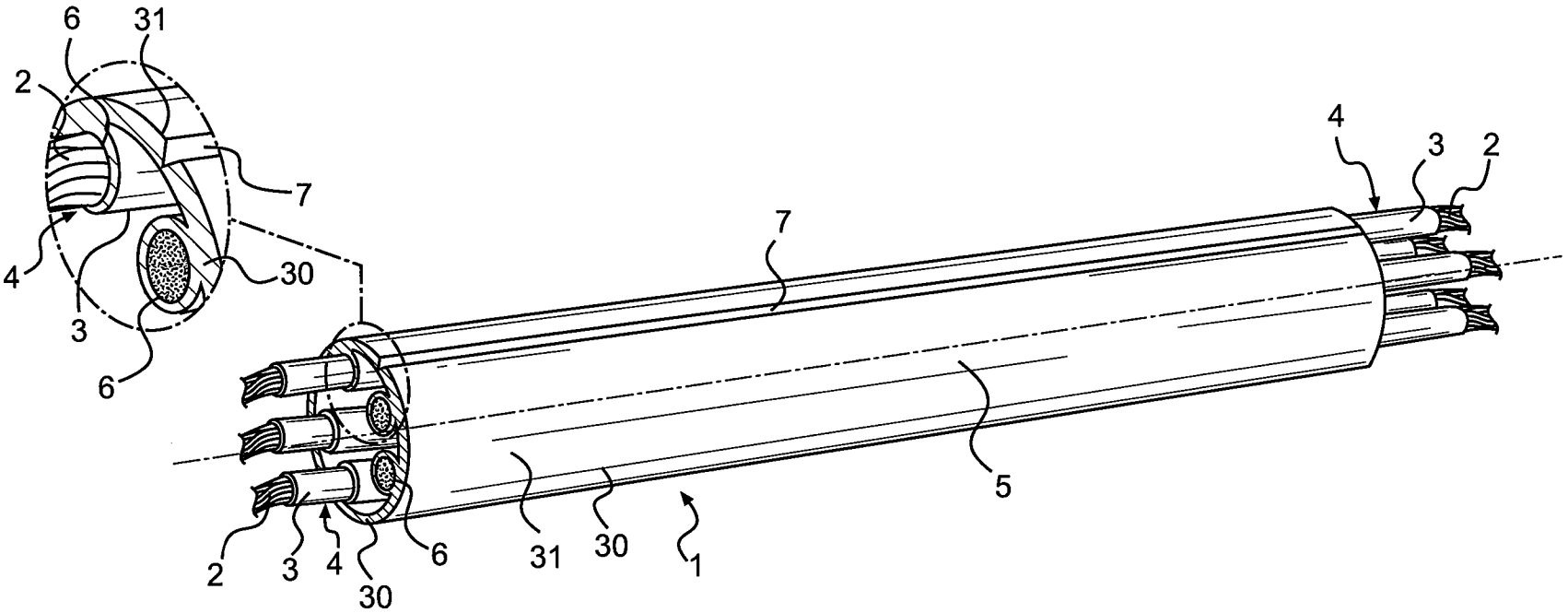
FIG. 9 PRIOR ART
FIG. 9 is a perspective view of the openable cable of FIG. 1, shown in closed configuration.

FIGS. 7 and 8 show a second preferred embodiment of the extrusion apparatus according to the invention for the production of a multipolar cable 14 for transmitting energy and/or signals, such as for example the openable multipolar cable 1 of FIGS. 1, 2 and 9.

In the following description and in said figures, the elements of the apparatus for the production of a multipolar cable for transmitting energy and/or signals which are structurally or functionally equivalent to those illustrated previously with reference to FIGS. 4 and 5, will be indicated with the same reference numbers and will not be further described.

According to this second preferred embodiment of extrusion apparatus of the invention, the first portion 38*a* of the female die 38 comprises a substantially smooth radially inner wall 132 provided with a longitudinal protrusion 33 of predetermined depth intended to form the weakening line 7 of the sheath 5 of the openable multipolar cable 1.

The extrusion head is indicated by 136 in the above-mentioned figures. The first portion 37*a* of the male die 37 comprises, in addition to the guiding ducts 40 described above with reference to the above-mentioned first preferred embodiment of the apparatus of the invention, a flow shutter element 48 positioned among the guiding ducts 40 to define a plurality of first interspaces 49 between the flow shutter element 48 and each of the guiding ducts 40, and a second substantially annular interspace 50 between the first portion 37*a* of the male die 37 and the first portion 38*a* of the female die 38.

The flow shutter element 48 has a shape substantially mating the plurality of the guiding ducts 40 and the first portion 38*a* of the female die 38.

The sheath 5 including five substantially tube-shaped longitudinal portions 30 of cable, reciprocally connected by an equal number of longitudinal connecting portions 31, is intended to be extruded through the interspaces 49 and 50.

In this manner, it is advantageously possible to produce, in a substantially continuous manner, the openable multipolar cable 1 shown in FIGS. 1, 2 and 9.

In the preferred embodiment illustrated, the flow shutter element 48 is mounted flush with the free end of the guiding ducts 40.

The flow shutter element 48 is longitudinally tapered in the direction opposite to the extrusion direction in order to facilitate the convey of the extrusion material into the above-mentioned plurality of first interspaces 49, and is mounted on the second portion 37*b* of the male die 37. In particular, the flow shutter element 48 is mounted on a supporting element 35 extending from the wall 34 of the male die 37. Preferably, the supporting element 35 is integrally formed with the truncated-cone section 43 of the male die 37.

By way of illustrative example, the flow shutter element 48 has a shorter length than the portions of guiding ducts 40 protruding from the second portion 37*b* of the male die 37, preferably equal to about 30-60% of the length of the portions of guiding ducts 40 protruding from the second portion 37*b* of the male die 37.

With reference to the second preferred embodiment of the apparatus described above, a second preferred embodiment of the method according to the invention for the production of the multipolar cable 1 for transmitting energy and/or signals includes the following steps.

In a preliminary step, the insulating layer 3 is extruded on the transmissive elements 4.

Subsequently, the steps described above with reference to the first preferred embodiment of the method of the invention are carried out, the second preferred embodiment of the method of the invention further comprising the step of carrying out the extrusion through the said plurality of first interspaces 49 formed between the flow shutter element 48 and the guiding ducts 40, and through the above-mentioned second interspace 50 formed between the first portion 37*a* of the male die 37 and the first portion 38*a* of the female die 38. In this manner, the sheath 5 of the openable multipolar cable 1 is formed in a substantially continuous manner.

Furthermore, the extrusion step is preferably carried out so as to form the sheath 5 provided with the longitudinal weakening line 7 at one of the connecting portions 31 for longitudinally opening the sheath 5 of the openable cable 1.

From what has been described and illustrated above, all the advantages achieved by the invention and especially those related to the possibility of producing in a substantial continuous manner a multipolar cable with improved compression resistance, which does not require to be opened in order to be connected at the preselected connection point, are immediately apparent.

The invention claimed is:

1. A multipolar cable for transmitting energy and/or signals comprising:

at least three transmissive elements;

a sheath in which at least three longitudinal housings are defined, said longitudinal housings being intended to house respectively said at least three transmissive elements according to a predetermined configuration and being formed within respective substantially lobe-shaped longitudinal portions of the sheath, the longitudinal housings being angularly staggered from each other by a predetermined angle; and a connector member comprising at least three perforating elements, a radially inner surface of the connector member having a substantially lobe-shaped portion which can be mated with a segment of the sheath.

2. The cable according to claim 1, wherein said substantially lobe-shaped longitudinal portions of the sheath are reciprocally connected by connecting portions having a predetermined bending radius.

3. The cable according to claim 1, wherein a further longitudinal housing is defined in said sheath, said further longitudinal housing being arranged centrally to the cable.

4. The cable according to claim 3, wherein said further longitudinal housing houses a longitudinal reinforcing element of the cable.

5. The cable according to claim 3, wherein said further longitudinal housing houses a neutral element of the cable.

6. The cable according to claim 3, wherein said further longitudinal housing has a substantially circular cross-section.

7. The cable according to claim 1, wherein said sheath is provided with at least two identifying elements of the transmissive elements formed at two adjacent substantially lobe-shaped longitudinal portions of the sheath.

* * * * *

UNITED STATES PATENT AND TRADEMARK OFFICE

CERTIFICATE OF CORRECTION

PATENT NO. : 7,642,462 B2
APPLICATION NO. : 10/584989
DATED : January 5, 2010
INVENTOR(S) : Paolo Veggetti et al.

It is certified that error appears in the above-identified patent and that said Letters Patent is hereby corrected as shown below:

On the title page, item (73), in the Assignee, please correct the name of the assignee as follows, --Prysmian Cavi e Sistemi Energia, S.r.l.--

Signed and Sealed this
Sixth Day of December, 2011

David J. Kappos

David J. Kappos
*Director of the United States Patent and Trademark Office*